US007156209B2

(12) United States Patent
Koeppe, Jr.

(10) Patent No.: US 7,156,209 B2
(45) Date of Patent: Jan. 2, 2007

(54) ELEVATOR ROPING ARRANGEMENT

(75) Inventor: Robert J. Koeppe, Jr., Newton, NJ (US)

(73) Assignee: Inventio AG, Hergiswil NW (CH)

( * ) Notice: Subject to any disclaimer, the term of this patent is extended or adjusted under 35 U.S.C. 154(b) by 172 days.

(21) Appl. No.: 10/857,210

(22) Filed: May 28, 2004

(65) Prior Publication Data

US 2006/0016641 A1 Jan. 26, 2006

(51) Int. Cl.
*B66B 11/08* (2006.01)

(52) U.S. Cl. ..... 187/266; 187/289; 187/250; 187/251; 187/276; 187/404

(58) Field of Classification Search ..... 187/251, 187/250, 262
See application file for complete search history.

(56) References Cited

U.S. PATENT DOCUMENTS

| | | | | |
|---|---|---|---|---|
| 5,062,501 | A * | 11/1991 | Pavoz et al. | 187/289 |
| 5,429,211 | A | 7/1995 | Aulanko et al. | |
| 5,490,579 | A * | 2/1996 | Ratcliffe et al. | 187/266 |
| 6,138,799 | A * | 10/2000 | Schroder-Brumloop et al. | 187/252 |
| 6,148,962 | A | 11/2000 | Hakala et al. | |
| 6,247,557 | B1 | 6/2001 | Kobayashi et al. | |
| 6,598,707 | B1 * | 7/2003 | Nakagaki et al. | 187/256 |
| 6,860,367 | B1 * | 3/2005 | Ericson | 187/265 |
| 2002/0070080 | A1 | 6/2002 | Nakagaki et al. | |
| 2003/0183458 | A1 * | 10/2003 | Mustalahti et al. | 187/254 |
| 2004/0168861 | A1 * | 9/2004 | Abe | 187/277 |
| 2006/0042885 | A1 * | 3/2006 | Kawasaki et al. | 187/406 |

FOREIGN PATENT DOCUMENTS

| | | |
|---|---|---|
| JP | 2002167137 | 6/2002 |
| JP | 2002179356 | 6/2002 |
| WO | WO 00/27739 | 5/2000 |
| WO | WO 03/043927 | 5/2003 |

* cited by examiner

*Primary Examiner*—Kathy Matecki
*Assistant Examiner*—Terrell Matthews
(74) *Attorney, Agent, or Firm*—Butzel Long

(57) ABSTRACT

An elevator installation includes an elevator car located in a hoistway and having a floor, and a rear wall extending upward from the floor. A counterweight is located in the hoistway adjacent to the rear wall of the elevator car. An underslung sheave assembly is located generally below the floor and preferably forms a V-shaped configuration that operatively engages the elevator car. A drive machine is mounted in the upper portion of the hoistway, and a drive sheave operatively engages the drive machine and is located above the counterweight, with the drive sheave having a front edge. A deflector sheave is also mounted in the upper part of the hoistway generally below the drive sheave and has a rear edge that vertically overlaps with the front edge of the drive sheave. A first rope and a second rope each have a first end attached to one of a first and a second dead end hitch in the upper portion of the hoistway, with the underslung sheave assembly operatively engaging the first and second ropes to support the elevator car and the counterweight operatively engaging the first and second ropes as the first and second ropes extend from the drive sheave to the counterweight, and with the first and second ropes extending from the underslung sheave assembly around the rear edge of the deflector sheave and the front edge of the drive sheave such that the first and second ropes wrap around the drive sheave greater than 180 degrees.

19 Claims, 3 Drawing Sheets

ELEVATOR ROPING ARRANGEMENT

BACKGROUND OF THE INVENTION

The present invention relates generally to roping configurations for elevators.

Elevators and their associated mechanical components are well known. Elevators are used to move people and equipment between floors in multistory buildings. A conventional traction type elevator installation includes an elevator car mounted in a car frame and moveable in a hoistway, a counterweight attached to the car via a rope, and a machine driving a traction or drive sheave that is engaged with the rope. As the machine turns the drive sheave, friction forces between the surface of the sheave and the rope move the rope and thereby cause the car and counterweight to raise and lower in opposite directions. The rope also can be routed through various turning or diverting sheaves when the drive sheave is not positioned directly above the car and the counterweight.

The mechanical components of the conventional elevator drive are generally located in a machine room, which room can be located at the top or bottom or to the side of the hoistway. Advances in elevator technology have led to the development of machine-room-less (MRL) elevator installations. As this name implies, this type of elevator mechanical system does not employ machine rooms at all. The MRL elevator applications have the goal of reducing the amount of building space occupied by the elevator systems, thereby increasing the amount of usable space on the floors.

As these MRL elevator installations become more common, a problem that arises with them, however, is that the elevator car and counterweight must be suspended within the hoistway in a different manner than in prior art elevator installations having machine rooms. For example, in order for MRL types of elevators to achieve minimum overhead requirements, small permanent magnet gearless machines are typically required. This is in contrast to the traditional elevator arrangements with machine room geared applications, where a large diameter traction sheave, which has ample tractive capabilities, can be used. This traditional arrangement can operate adequately with a one-to-one roping arrangement at less than 180 degrees wrapping of the ropes around the drive sheave, which allows for the use of a deflector sheave to achieve the desired location of rope drops even though the wrapping on the drive sheave is less than 180 degrees.

However, the small machines employed in MRL applications tend to require small sheave diameters for the drive sheaves. With these smaller sheave diameters, a full 180 degree wrap is needed with a two-to-one roping arrangement. In order to accommodate these needs with conventional steel suspension ropes, the elevator configurations tend to require a configuration with the counter weight mounted on the side of the elevator car. But a side mounted counter weight configuration creates hoistway packaging issues in certain standard sized hoistways that are designed for front opening elevators with rear located counter weights. To overcome this, some are employing belts or synthetic (for example, aramid) ropes, which can allow for configurations with more total and more severe bends without adversely affecting the rope life. These bends in conventional steel suspension ropes may not be particularly desirable. Thus, these configurations may limit the choice of the type of roping employed in the elevator installation.

It is desirable, therefore, to improve upon the configuration of the suspension rope and sheaves in MRL configurations of traction-type elevator installations that will allow for rear mounted counterweights, while not being too limiting of the type of roping employed.

SUMMARY OF THE INVENTION

An embodiment of the present invention concerns a novel arrangement and configuration for an elevator installation for use in a hoistway having an upper portion. The elevator installation according to the present invention preferably includes an elevator car having a floor, and a rear wall extending upward from the floor, and with the elevator car being located in the hoistway. A counterweight is located in the hoistway adjacent to the rear wall of the elevator car, and an underslung sheave assembly is located generally below the floor and operatively engages the elevator car. The elevator installation also preferably includes a drive machine mounted in the upper portion of the hoistway, a drive sheave operatively engaging the drive machine and located above the counterweight, with the drive sheave having a front edge, and a deflector sheave mounted in the upper part of the hoistway generally below the drive sheave and having a rear edge that vertically overlaps with the front edge of the drive sheave. The elevator installation of the present invention also includes a first rope and a second rope, each having a first end attached to one of a first and a second dead end hitch in the upper portion of the hoistway, with the underslung sheave assembly operatively engaging the first and second ropes to support the elevator car and the counterweight operatively engaging the first and second ropes as the first and second ropes extend from the drive sheave to the counterweight, and with the first and second ropes extending from the underslung sheave assembly around the rear edge of the deflector sheave and the front edge of the drive sheave such that the first and second ropes wrap around the drive sheave greater than 180 degrees.

An embodiment of the present invention also concerns a novel arrangement and configuration for an elevator installation for use in a hoistway having an upper portion. The elevator installation according to the embodiment of the present invention preferably includes an elevator car having a floor, a rear wall extending upward from the floor, a front in opposed relation to the rear wall, a first side wall extending between the rear wall and the front and a second, opposed side wall extending between the rear wall and the front, and with the elevator car being located in the hoistway. A counterweight is located in the hoistway adjacent to the rear wall of the elevator car, a drive machine is mounted in the upper portion of the hoistway, and a drive sheave operatively engages the drive machine and is located above the counterweight. A deflector sheave is mounted in the upper part of the hoistway generally below the drive sheave. The elevator installation also preferably includes an underslung sheave assembly located generally below the floor and operatively engaging the elevator car, and including a first underslung sheave being located under the floor along the rear wall about mid-way between the first and second side walls, a second underslung sheave being located under the floor along the first side wall adjacent to the front, a third underslung sheave being located under the floor along the rear wall adjacent to the first underslung sheave, and a fourth underslung sheave being located under the floor along the second side wall adjacent to the front; and a first rope and a second rope, each having a first end attached to one of a first and a second dead end hitch in the upper portion of the hoistway, with the first underslung sheave and the second underslung sheave operatively engaging the first rope and the third underslung sheave and the fourth underslung sheave operatively engaging the second rope to support the elevator car, and with the first and second ropes extending from the underslung sheave assembly around the deflector sheave and the drive sheave such that the first and second ropes wrap around the drive sheave, and with the counterweight operatively engaging the first and second ropes as the first and second ropes extend from the drive sheave to the counterweight.

The elevator assembly according to an embodiment of the present invention advantageously permits the location of a counterweight in a rear configuration for an MRL elevator installation without less limitations on the type of roping employed. Moreover, this elevator assembly provides this configuration while assuring a balanced loading of the elevator car.

The elevator assembly according to an embodiment of the present invention also provides for a deflector sheave located relative to the drive sheave so that the ropes wrap around the drive sheave greater than 180 degrees, thus assuring the desired tractive capabilities.

The elevator assembly according to an embodiment of the present invention also provides for an underslung sheave assembly that allows for full, balanced support of the elevator car while allowing the ropes to extend from the underslung sheave assembly to a single deflector sheave and a single drive sheave.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
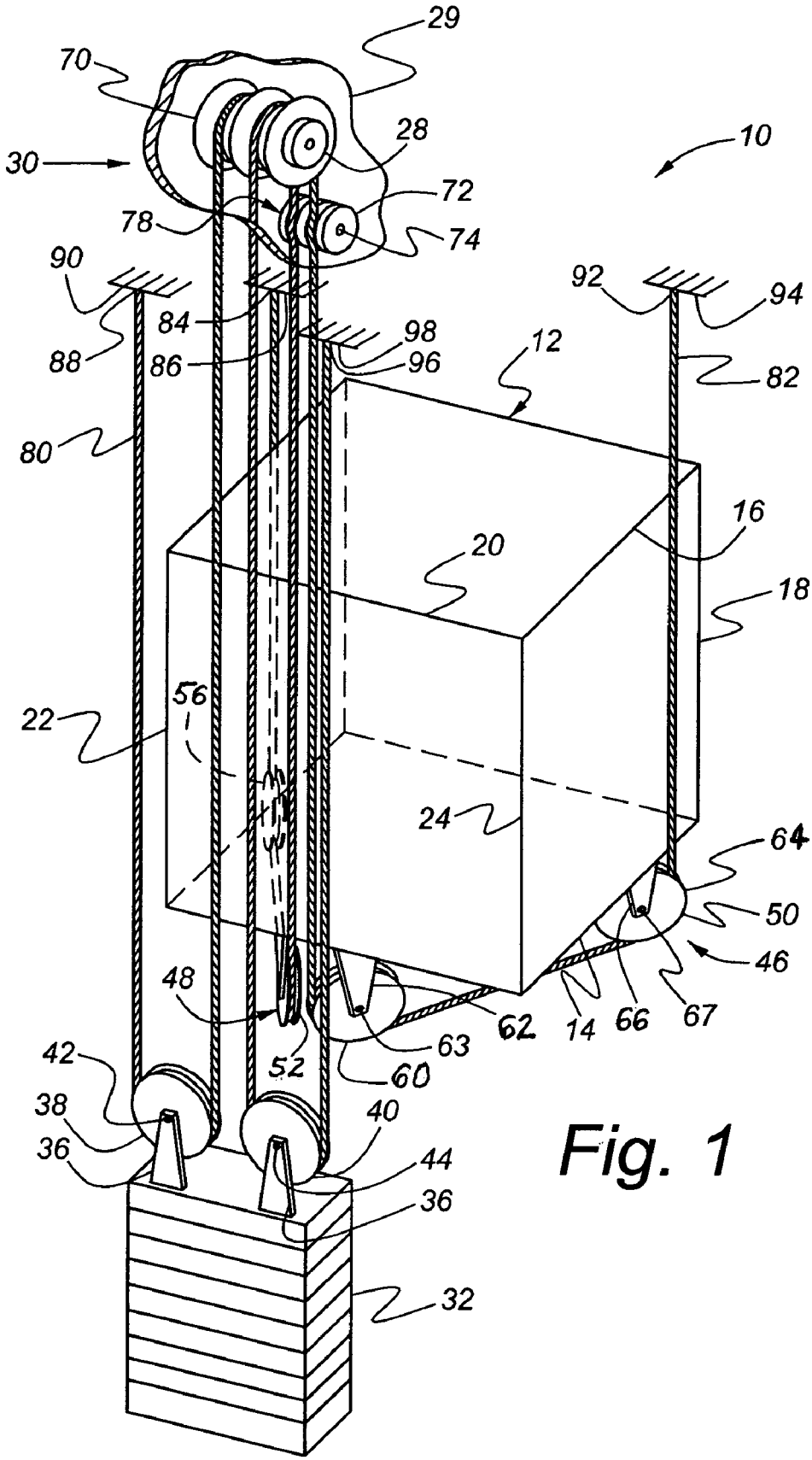
FIG. 1 is a schematic illustration, in perspective view, of a portion of an elevator installation in accordance with the present invention.
Figure 2:
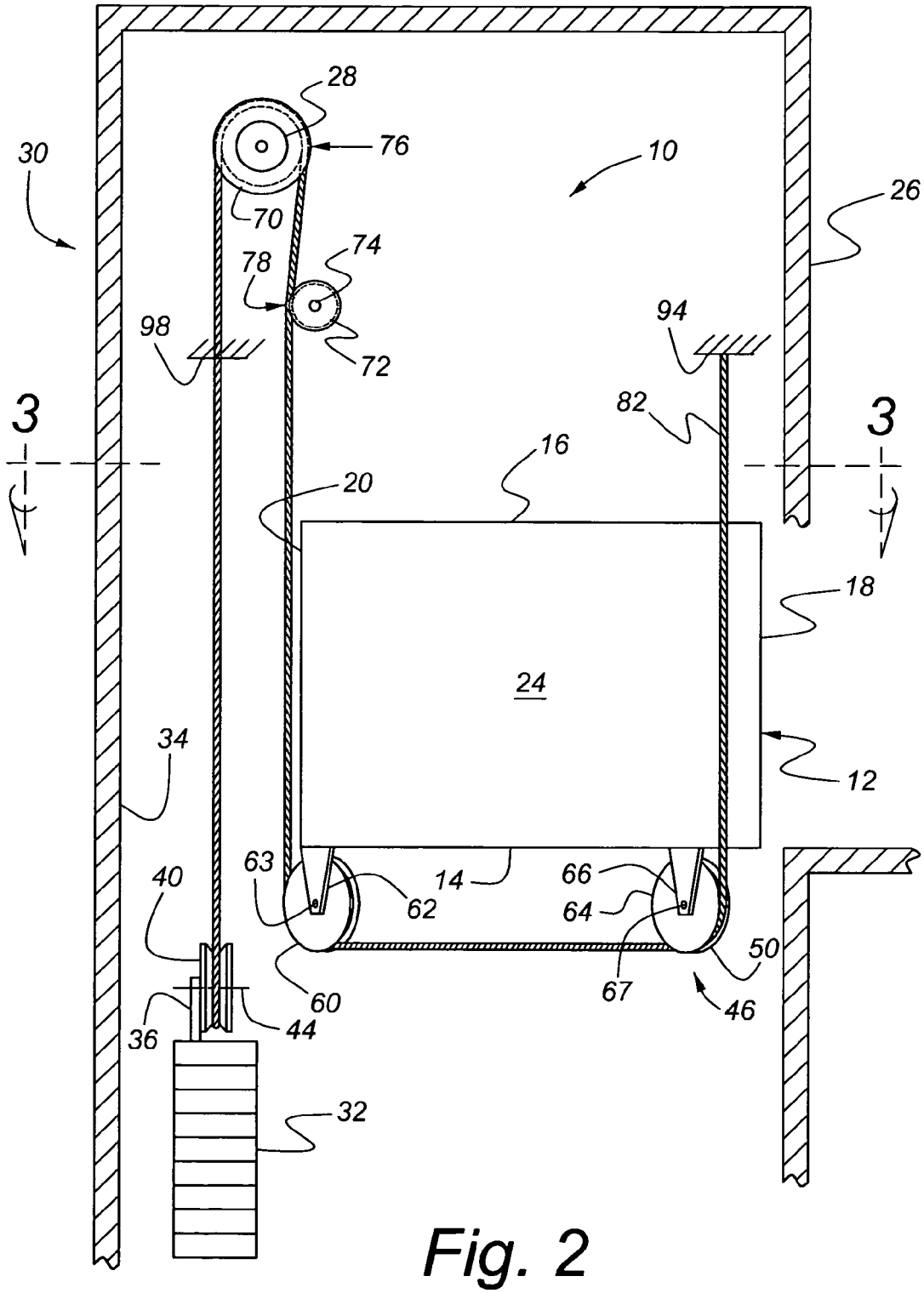
FIG. 2 is a schematic illustration, in side elevation view, of the elevator installation of FIG. 1.
Figure 3:
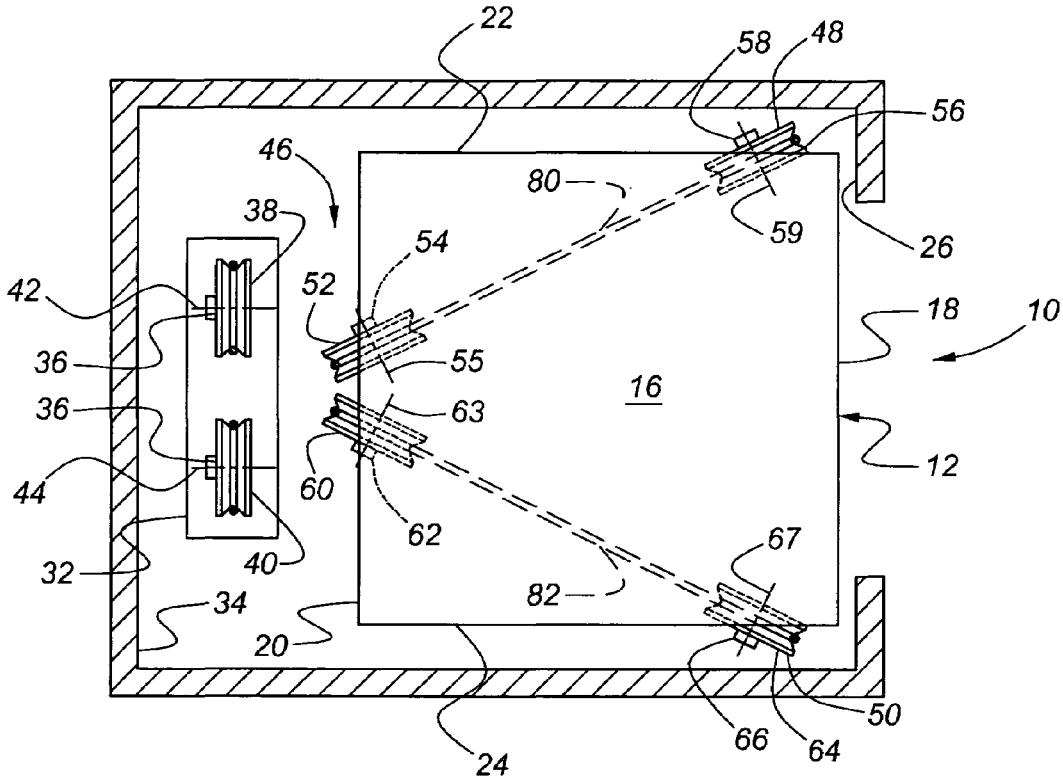
FIG. 3 is a schematic illustration, in plan view, of the elevator installation looking in the direction of arrows 3—3 in FIG. 2.

Referring now to FIGS. 1–3, an elevator installation in accordance with the present invention is indicated generally at 10. This elevator installation is an MRL configuration, with the elevator components mounted in an elevator hoistway 26, rather than providing a machine room located outside of the hoistway 26. The elevator installation includes an elevator car 12, which includes a floor 14, a roof 16, a front 18, a rear wall 20, a first side wall 22 and a second side wall 24. The elevator car 12 is disposed in the elevator hoistway 26 and is operable to move along a conventional vertical elevator travel path. The elevator car 12 is mounted to slide along and be guided by elevator guide rails (not shown) in a conventional fashion.

The elevator car 12 is supported by an underslung sheave assembly 46, which includes a first underslung sheave subassembly 48 and a second underslung sheave subassembly 50. The first underslung sheave subassembly 48 has a first underslung sheave 52 that mounts—via a support 54 that secures it about an axis 55—under the floor 14 of the elevator car 12 near the middle of the rear wall 20, and a second underslung sheave 56 that mounts—via a support 58 that secures it about an axis 59—under the floor 14 near the front of the first side wall 22. The supports 54, 58 can be any structure that axially fixes the sheaves 52, 56 to the elevator car 12 while allowing for rotation of the sheaves 52, 56 about their respective axes 55, 59, which structures are known to those skilled in the art. The second underslung sheave subassembly 50 has a third underslung sheave 60 that mounts—via a support 62 that secures it about an axis 63—under the floor 14 near the middle of the rear wall 20, and a fourth underslung sheave 64 that mounts—via a support 66 that secures it about an axis 67—under the floor 14 near the front of the second side wall 24. Again, the supports 62, 66 can be any structure that axially fixes the sheaves 60, 64 to the elevator car 12 while allowing for rotation of the sheaves 60, 64 about their respective axes 63, 67, which structures are known to those skilled in the art.

The first and second underslung sheave subassemblies 48, 50 form a symmetrical, generally V-shaped configuration under the elevator car 12. This configuration assures full and balanced support of the car 12, while also allowing the first and third underslung sheaves 52, 60 to be located adjacent to each other.

A counterweight 32 is also mounted in the hoistway 26 between the rear wall 20 and a back 34 of the hoistway 26. The counterweight 32 is mounted to slide along and be guided by counterweight guide rails (not shown) in a conventional fashion. A pair of counterweight supports 36 axially secure a first counterweight sheave 38 and a second counterweight sheave 40 to the counterweight 32 while allowing the counterweight sheaves 38, 40 to rotate freely about their respective axes 42, 44. The counterweight supports 36 can be any structure that axially fixes the counterweight sheaves 38, 40 to the counterweight 32, while allowing for rotation of the sheaves 38, 40 about their respective axes 42, 44, which structures are known to those skilled in the art. While the counterweight sheaves 38, 40 are shown oriented generally parallel to the counterweight 32, they may be oriented in other directions, if so desired. Such as, for example, the counterweight sheaves 38, 40 may be oriented generally perpendicular to the counterweight 32.

A drive machine 28 is mounted to support structure 29 in an overhead area, that is, an upper portion (indicated generally at 30) of the hoistway 26. This upper portion 30 is above the level to which the elevator car 12 can rise. That is, the upper portion 30 is generally the area above the elevator car 12 when it is at the topmost landing of the hoistway 26. This also may be referred to as a hoistway overhead. The drive machine 28 is preferably a small, permanent magnet, gearless, electric motor, but a different type of machine (including a different type of motor) may be employed if so desired. A drive sheave 70 is mounted in the upper portion 30 of the hoistway 26 and is rotationally driven by the drive machine 28. A deflector sheave 72 is also mounted to the support structure 29 in the upper portion 30 of the hoistway 26. The support structure 29 can be any such structure that axially fixes the deflector sheave 72, while allowing it to rotate about is axis 74. The deflector sheave 72 is located below the drive sheave 70, and with a vertical overlap between a front edge 76 of the drive sheave 70 and a rear edge 78 of the deflector sheave 72.

The elevator installation 10 includes a first rope 80 and a second rope 82. The ropes 80, 82 can be formed from multiple strands (for example three) typical of steel suspension ropes, a belt, or ropes formed of a synthetic material (for example aramid). Although, it is particularly advantageous to employ conventional steel suspension ropes since this elevator installation 10 employs a relatively small number of bends that are also less severe than other MRL applications with rear counterweight configurations. The term rope as used herein may include a rope set, which has multiple ropes aligned adjacent to one another and acted upon in unison as if they were a single rope.

A first end 84 of the first rope 80 is secured to a first dead end hitch 86, which is secured in the upper portion 30 of the hoistway 26 above the second underslung sheave 56. The first rope 80 extends downward from the first dead end hitch 86, around the second underslung sheave 56, and around the first underslung sheave 52. The first rope 80 then extends upward around the rear edge 78 of the deflector sheave 72, and then angles around the front edge 76 and over the top of the drive sheave 70. From the drive sheave 70, the first rope 80 extends down around the first counterweight sheave 38 and upward to where its second end 88 is secured to a second dead end hitch 90 in the upper portion 30 of the hoistway 26.

The second rope 82 has a first end 92 that is secured to a third dead end hitch 94, which is secured in the upper portion 30 of the hoistway 26 above the fourth underslung sheave 64. The second rope 82 extends downward from the third dead end hitch 94, around the fourth underslung sheave 64, and around the third underslung sheave 60. The second rope 82 then extends upward around the rear edge 78 of the deflector sheave 72, and then angles around the front edge 76 and over the top of the drive sheave 70. From the drive sheave 70, the second rope 82 extends down around the second counterweight sheave 40 and upward to where its second end 96 is secured to a fourth dead end hitch 98 in the upper portion 30 of the hoistway 26.

The first and second ropes 80, 82, then, fully support the elevator car 12 and the counterweight 32, with the drive sheave 70 driven by the drive machine 28 to cause the elevator car 12 and the counterweight 32 to selectively move up and down in opposed motion. The V-shaped configuration of the underslung sheave assembly 46 allows the elevator car 12 to be fully supported and balanced, both front-to-back and side-to-side, while allowing the first and second ropes 80, 82 to be adjacent to each other as they extend upward along the rear wall 20 of the elevator car 12 to the deflector sheave 72 and drive sheave 70. In this way, only one deflector sheave 72 and one drive sheave 70 are required. In addition, with this elevator installation 10 having a vertical overlap between the rear edge 78 of the deflector sheave 72 and the front edge 76 of the drive sheave 70, the deflector sheave 72 will cause the angle of wrap around the drive sheave 72 to be greater than 180 degrees. This wrap of greater than 180 degrees assures that sufficient tractive capabilities are provided for any type of roping used in this elevator installation 10. Also, the drive sheave 70 positions the first and second ropes 80, 82 so they extend downward to a rear located counterweight 32 without interfering with the portions of the ropes 80, 82 extending around the underslung sheave assembly 46.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation for use in a hoistway having an upper portion, the elevator installation comprising:

an elevator car being located in the hoistway and having a floor, said elevator car having a front, a rear wall and opposed side walls extending upward from said floor;

a counterweight located in the hoistway adjacent to said rear wall of said elevator car;

an underslung sheave assembly mounted on said elevator car below said floor;

a drive machine mounted in the upper portion of the hoistway;

a drive sheave operatively engaging said drive machine and located above said counterweight, with said drive sheave having a front edge;

a deflector sheave mounted in the upper portion of the hoistway generally below said drive sheave and having a rear edge that vertically overlaps with said front edge of said drive sheave; and a first rope and a second rope each having a first end attached to an associated one of a pair of dead end hitches in the upper portion of the hoistway, said first and second ropes extending along adjacent ones of said side walls near said front of said elevator car and into operative engagement with said underslung sheave assembly to support said elevator car, said first and second ropes extending from said underslung sheave along said rear wall of said elevator car, said first and second ropes extending around said rear edge of said deflector sheave and said front edge of said drive sheave such that said first and second ropes wrap around said drive sheave greater than 180 degrees, and said first and second ropes operatively engaging said counterweight whereby said front of said elevator car is unobstructed for use as an; wherein said underslung sheave assembly includes a first underslung sheave and a second underslung sheave operatively engaging said first rope and a third underslung sheave and a fourth underslung sheave operatively engaging said second rope, said first underslung sheave being located adjacent said rear wall about mid-way between said side walls, said second underslung sheave being located adjacent one of said side walls and near said front, said third underslung sheave being located adjacent said rear wall near said first underslung sheave, and said fourth underslung sheave being located adjacent another of said side walls and near said front.

2. The elevator installation of claim 1 wherein said counterweight includes a first and a second counterweight sheave mounted thereto, and said first and second ropes each have a second end affixed to an associated one of another pair of dead end hitches in the upper portion of the hoistway, and said first counterweight sheave operatively engages said first rope below said associated one of said another pair of dead end hitches and said second counterweight sheave operatively engages said second rope below said associated one of said another pair of dead end hitches.

3. The elevator installation of claim 2 wherein the first and second ropes are steel suspension ropes.

4. The elevator installation of claim 1 wherein said counterweight includes a first and a second counterweight sheave mounted thereto, and said first and second ropes each have a second end affixed to an associated one of another pair of dead end hitches in the upper portion of the hoistway, and said first counterweight sheave operatively engages said first rope below said associated one of said another pair of dead end hitches and said second counterweight sheave operatively engages said second rope below said associated one of said another pair of dead end hitches.

5. The elevator installation of claim 1 wherein said first and second ropes are steel suspension ropes.

6. The elevator installation of claim 1 wherein said first and second ropes are belts.

7. The elevator installation of claim 1 wherein said first and second ropes are formed of a synthetic material.

8. The elevator installation of claim 1 wherein said drive machine is a permanent magnet, gearless machine.

9. An elevator installation for use in a hoistway having an upper portion, the elevator installation comprising:

an elevator car having a floor, a rear wall extending upward from said floor, a front in opposed relation to said rear wall, a first side wall extending between said rear wall and said front and a second, opposed side wall extending between said rear wall and said front, and said elevator oar being located in the hoistway;

a counterweight located in the hoistway adjacent to said rear wall of said elevator ear;

a drive machine mounted in the upper portion of the hoistway;

a drive sheave operatively engaging said drive machine and located above said counterweight;

a deflector sheave mounted in the upper portion of the hoistway generally below said drive sheave;

an underslung sheave assembly mounted on said elevator car below said floor and including a first underslung sheave located adjacent to said rear wall about mid-way between said first and second side walls, a second underslung sheave located adjacent to said first side wall near said front, a third underslung sheave located adjacent to said rear wall and to said first underslung sheave, and a fourth underslung sheave located adjacent to said second side wall and near said front; and a first rope and a second rope each having a first end attached first and third dead end hitches respectively in the upper portion of the hoistway, with said first underslung sheave and said second underslung sheave operatively engaging said first rope and said third underslung sheave and said fourth underslung sheave operatively engaging said second rope to support said elevator car, and with said first and second ropes extending from said underslung sheave assembly round said deflector sheave and said drive sheave such that said first and second ropes wrap around said drive sheave, and with said counterweight operatively engaging said first and second ropes as said first and second ropes extend from said drive sheave to second and fourth dead end hitches respectively whereby said first and second ropes extend along said first and second side walls respectively and said front of said elevator car is unobstructed for use as an entrance.

10. The elevator installation of claim 9 wherein said drive sheave has a front edge and said deflector sheave has a rear edge that vertically overlaps with said front edge of said drive sheave, and said first and second ropes extend from the underslung sheave assembly around the rear edge of the deflector sheave and the front edge of the drive sheave such that the first and second ropes wrap around the drive sheave greater than 180 degrees.

11. The elevator installation of claim 10 wherein the first and second ropes are steel suspension ropes.

12. The elevator installation of claim 9 wherein said counterweight includes a first and a second counterweight sheave mounted thereto, and said first and second ropes each have a second end affixed to said second and fourth dead end hitches respectively, and said first counterweight sheave operatively engages said first rope below said second dead end bitch and said second counterweight sheave operatively engages said second rope below said fourth dead end hitch.

13. The elevator installation of claim 9 wherein said first and second ropes are steel suspension ropes.

14. The elevator installation of claim 9 wherein said first and second ropes are belts.

15. The elevator installation of claim 9 wherein said first and second ropes are formed of a synthetic material.

16. The elevator installation of claim 9 wherein said drive machine is a permanent magnet type machine.

17. The elevator installation of claim 16 wherein said drive machine is a gearless machine.

18. An elevator installation for use in a hoistway having an upper portion, the elevator installation comprising:

an elevator car having a floor, a rear wall extending upward from said floor, a front in opposed relation to said rear wall, a first side wall extending between said rear wall and said front and a second, opposed side wall extending between said rear wall and said front, and with said elevator car being located in the hoistway;

a counterweight located in the hoistway adjacent to said rear wall of said elevator car;

a drive machine mounted in the upper portion of the hoistway;

a drive sheave operatively engaging said drive machine and located above the counterweight, wit the drive sheave having a front edge;

a deflector sheave mounted in the upper portion of the hoistway generally below said drive sheave and having a rear edge that vertically overlaps with said front edge of said drive sheave;

an underslung sheave assembly mounted to said elevator car below said floor and including a first underslung sheave located adjacent said rear wall about mid-way between said first and second side walls, a second underslung sheave located adjacent said first side wall near said front, a third underslung sheave located adjacent said rear wall near said first underslung sheave, and a fourth underslung sheave located adjacent said second side wall near said front; and a first rope and a second rope each having a first end attached to an associated one of a first and a third dead end hitch in the upper portion of the hoistway, said first underslung sheave and the second underslung sheave operatively engaging said first rope and said third underslung sheave and said fourth underslung sheave operatively engaging said second rope to support said elevator car, said first and second ropes extending from said underslung sheave assembly around said rear edge of said deflector sheave and said front edge of said drive sheave such that said first and second ropes wrap around said drive sheave greater than 180 degrees, and said counterweight operatively engaging said first and second ropes as said first and second ropes extend from said drive sheave to second and fourth dead end hitches respectively.

19. The elevator installation of claim 18 wherein said counterweight includes a first and a second counterweight sheave mounted thereto, said first and second ropes each have a second end affixed to said second and fourth dead end hitches respectively, and said first counterweight sheave operatively engages said first rope below said second dead end hitch and said second counterweight sheave operatively engages said second rope below said fourth dead end hitch.

* * * * *